US005293817A

United States Patent [19]

Nüssel et al.

[11] Patent Number: 5,293,817

[45] Date of Patent: Mar. 15, 1994

[54] COMBINED DAMPENING AND LITHOGRAPHIC FORM CYLINDER AND METHOD OF IMAGING

[75] Inventors: Barbara Nüssel, Friedberg-Stätzling; Josef Schneider, Diedorf-Lettenbach, both of Fed. Rep. of Germany

[73] Assignee: MAN Roland Druckmaschinen AG, Offenbach am Main, Fed. Rep. of Germany

[21] Appl. No.: 928,871

[22] Filed: Aug. 11, 1992

[30] Foreign Application Priority Data

Sep. 12, 1991 [DE] Fed. Rep. of Germany ..... 4130264

[51] Int. Cl.[5] ..... B41F 7/32; B41N 1/08

[52] U.S. Cl. ..... 101/148; 101/450.1; 101/453; 101/466

[58] Field of Search ..... 101/130, 148, 348, 367, 101/450.1, 453, 451, 452, 465, 466

[56] References Cited

U.S. PATENT DOCUMENTS

| | | | |
|---|---|---|---|
| 683,478 | 10/1901 | Meyer | 101/141 |
| 1,201,599 | 10/1916 | Lutz | 101/451 |
| 2,302,816 | 11/1942 | Toland et al. | 101/451 |
| 2,464,040 | 3/1949 | Huebner | 101/148 |
| 2,913,980 | 11/1959 | Lindemann | 101/148 |
| 3,059,573 | 10/1962 | Marzullo | 101/148 |
| 3,923,936 | 12/1975 | Davis et al. | 101/148 |
| 4,458,399 | 7/1984 | Kessler | 101/367 |
| 4,967,663 | 11/1990 | Metcalf | 101/348 |
| 5,046,417 | 9/1991 | Paulson | 101/148 |

FOREIGN PATENT DOCUMENTS

| | | | |
|---|---|---|---|
| 0264604 | 4/1988 | European Pat. Off. . | |
| 0396114 | 11/1990 | European Pat. Off. . | |
| 0400595 | 12/1990 | European Pat. Off. . | |
| 2329744 | 1/1974 | Fed. Rep. of Germany . | |
| 3636129 | 5/1988 | Fed. Rep. of Germany . | |
| 3840137 | 3/1990 | Fed. Rep. of Germany . | |
| 9012211 | 12/1990 | Fed. Rep. of Germany . | |
| 487903 | 12/1953 | Italy | 101/148 |

*Primary Examiner*—Edgar S. Burr
*Assistant Examiner*—Stephen R. Funk
*Attorney, Agent, or Firm*—Frishauf, Holtz, Goodman & Woodward

[57] ABSTRACT

To permit elimination of dampening rollers or an entire dampener in a lithographic, preferably offset printing machine, the printing form is formed as a cylindrical sleeve or jacket (3) fitted over a core (2), in which the cylindrical sleeve or jacket is formed with a plurality of interconnected pores (5), essentially uniformly distributed over the surface (4) and forming, within the sleeve or jacket, a connected pore fluid transfer network. Dampening fluid is then applied to the interior of the sleeve or jacket, for example from a chamber (6) between the cylindrical core (2) and the inner surface of the sleeve or jacket. The outer surface (4) can be imaged with oleophilic substances, for example by a thermal transfer process. To remove the images, for re-use of the printing form without removal from a printing machine, hot gases for example steam can be applied to the interior of the sleeve or jacket, so that the oleophilic substances at the outside will loosen for easy removal, or spall off.

16 Claims, 1 Drawing Sheet

COMBINED DAMPENING AND LITHOGRAPHIC FORM CYLINDER AND METHOD OF IMAGING

Reference to related patent, the disclosure of which is hereby incorporated by reference:

U.S. Pat. No. 4,967,663, Metcalf.

Reference to related publications:

U.S. Pat. No. 4,846,065, Mayrhofer et al, assigned to an associated company of the assignee of the present application, to which German 36 36 129 corresponds. German Patent 38 40 137.

FIELD OF THE INVENTION

The present invention relates to form cylinders for lithographic printing, and more particularly to a form cylinder for an offset printing machine, in which an image applied to the form cylinder can be erased, and in which the form cylinder has a surface which is hydrophilic or can be rendered selectively hydrophilic with adjacent oleophilic regions, in accordance with an image or subject matter to be printed; and to a method of dampening those areas of the form cylinders which are to remain hydrophilic upon imaging the printing cylinder.

BACKGROUND

German Patent 36 36 129, and corresponding U.S. Pat. No. 4,846,065, Mayrhofer et al, assigned to an associated company of the assignee of the present application, describe a form cylinder which has a cylinder sleeve with a surface from which printing is to be effected, which surface has heat insulating properties and, generally, is hydrophilic. The sleeve, applied for example over a core or shaft, or the form cylinder itself can be associated with an image or printing subject matter transfer unit, located within the printing machine, over which imaging or subject matter information can be transferred to the surface of the form cylinder, in the form of oleophilic surface elements. The image information, that is, the oleophilic surface elements can be erased so that the form cylinder can be re-imaged without removal from the printing machine, and a new printing subject matter or printing image can be applied thereto. The oleophilic regions are inked as usual in the printing machine, for example prior to transfer of the image information to a blanket or offset cylinder; dampening fluid is supplied from a customary dampener, for example by dampener application rollers and the like, or, for example, by a combination inker-dampening fluid application roller.

U.S. Pat. No. 4,967,663, Metcalf, describes an unengraved metering roll made of porous ceramic material for depositing measured amounts of liquid as a coating on a substrate, such as a metal can. The pores in the ceramic accept the ink and replace the engraved pattern previously used on the outer surface of the roll. Manufacture of such a porous ceramic cylinder is known, and the referenced U.S. Pat. No. 4,967,663, Metcalf, describes, in detail, how such a porous cylinder or roll can be made. The size and number of the pores is determined by organic fillers added to the ceramic mass. Upon firing the ceramic mass, the organic fillers burn off and what is left is a porous ceramic body. Suitable organic fillers or additives are, for example, walnut shell flour, sawdust, straw dust, fish oil or the like.

Another method to make porous ceramic bodies, in form of a ceramic lattice or skeleton, is described in German Patent 38 40 137, Burger et al. A plastic foam, for example a polyurethane foam, is dipped into a ceramic suspension. Upon firing of the ceramic, the plastic foam burns out, and what is left is a foam or porous ceramic. The dimensions of the pores, for example pore diameters or average diameters, between 3 and 100 micrometers can be obtained, and the relative sizes of the pores can be controlled. A porosity of between 2% and 90% is obtainable, in dependence on the control of the process and the initial foam substance.

THE INVENTION

It is an object to provide a porous ceramic cylinder in such a way that it can be directly imaged and, selectively, erased, so that the ceramic cylinder can be installed as a re-usable form cylinder and which, additionally, can receive dampening fluid without requiring dampening fluid application rollers and/or oscillating combination inker-dampening fluid rollers, whereby the roller will be self-dampening so that the surface of the ceramic cylinder will carry a lithographic image ready for inking and printing; and to a method of dampening a lithographic form cylinder.

Briefly, a form cylinder is used which has an outer surface formed with a plurality of pores which, essentially, are of the same size and uniformly distributed. The pore size and the number of pores is controlled during manufacture of the cylinder. A preferred porosity is between about 20% and 45%. Preferably, the diameter of the pores is additionally so controlled that it decreases from the inside of the cylinder sleeve towards the outer surface thereof. The diameters of the pores can be between about 0.003 mm to 0.1 mm, and the pores may vary within the cylinder within this range. The pores of the ceramic cylinder are in communication with each other, to form a connected pore network so that dampening fluid can be applied to the inside of the cylinder or the sleeve and reach the surface thereof, thereby making the cylinder self-dampening.

Supply of dampening fluid through the cylinder core or support or shaft can be done in well known manner, for example similar to arrangements customarily used to cool dampening rollers or inker rollers, especially vibrating or oscillating inker rollers. Preferably, a dampening fluid space or chamber is located between the cylinder core and the cylinder sleeve. Dampening fluid supply lines and excess fluid drain lines can be connected to this chamber.

Suitable porous ceramics for use in the sleeve or the cylinder of the present invention are aluminum oxide ($Al_2O_3$), zirconium oxide ($ZrO_3$), cordierite (Al-Mg-silicate), steatite (Mg-silicate) or silicon carbide (SiC).

Other materials than ceramics, also essentially non-compressible, may be used, for example glass or metals or metal alloys. Manufacture of porous bodies made of metal is well known in connection with filter technology, where the filters are made of sintered metals. Also, sintered metals in tubular form are well known; the control of different pore size, as well as the distribution of pore size within the body, likewise is well known from powder metallurgy technology, in which the metal is being sintered. Suitable materials for the cylinder or a cylinder sleeve are bronze of various types and chromium-nickel alloys.

DRAWINGS

DETAILED DESCRIPTION

Figure 1:
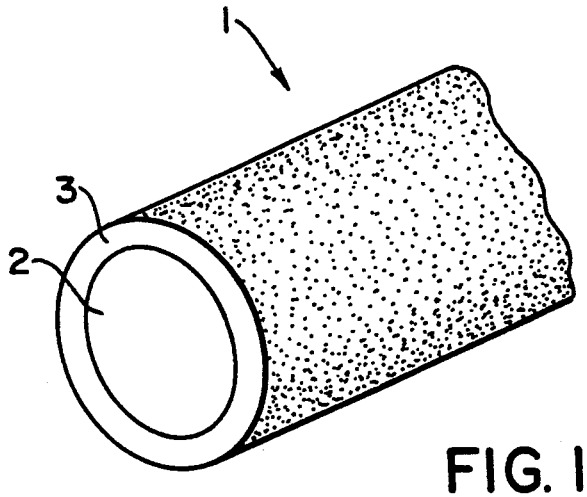
FIG. 1 is a highly schematic fragmentary isometric view of a cylinder in accordance with the present invention.

A form cylinder 1 (FIG. 1) has a cylinder core or cylinder shaft 2 of any customary or suitable material, for example iron. In accordance with a preferred embodiment of the invention, the shaft may be made of steel. The shaft 2 is surrounded by a jacket or sleeve 3 made of porous ceramic material. If the porosity of the material of the sleeve 3 is high, steel is the preferred material for the core 2 for better mechanical stabilization of the sleeve or jacket 3.

Figure 2:
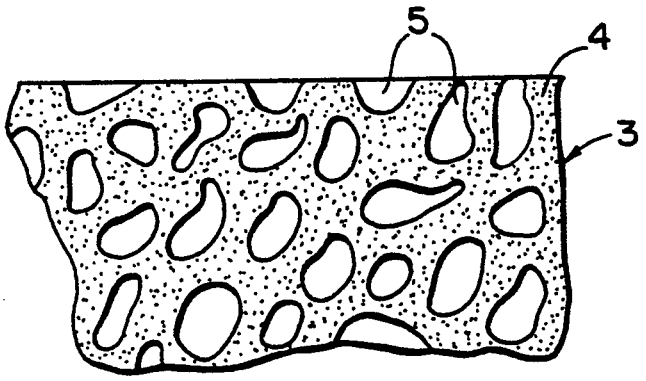
FIG. 2 is a fragmentary enlarged view illustrating the surface of the cylinder or, rather, the cylinder sleeve.

The surface 4 of the sleeve 3 is seen, in developed fragmentary representation, in FIG. 2. It is hydrophilic and is interrupted by essentially uniformly distributed pores 5 open to the surface 4. The surface area of the pores 5 again is essentially uniform. The surface 4 is the surface which can be rendered oleophilic in accordance with subject matter or images to be printed.

Figure 3:
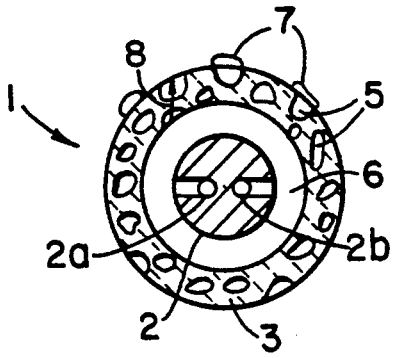
FIG. 3 is a transverse section through the form cylinder in accordance with the present invention.

A cross section of the form cylinder 1 is seen, in fragmentary schematic representation, in FIG. 3. A dampening fluid space or chamber 6 is located between the core 2 and the cylinder jacket or sleeve 3 in the region of the cylinder where printing is to be effected. The space 6 is confined at the end portions of the cylinder by suitable end shields or caps. The pores 5 communicate between the space 6 and the surface 4, to form a connected pore fluid transmission network. Suitable fluid supply ducts 2*a* and excess fluid removal ducts 2*b* extend axially through the core—or are formed as grooves or the like at the surface thereof—to supply dampening fluid into the chamber 6.

The basic structure and operation of supply of dampening fluid to the interior of a cylinder is well known in connection with cooled dampening fluid rollers or inker rollers, and especially vibrating inker rollers, and any suitable construction well known in the printing machinery field may be used. Any holding structures which may be necessary to define the chamber 6, such as ribs, spiders or other support elements, have been omitted from the drawings; they can be used, if necessary.

The cylinder sleeve or jacket 3 can be imaged directly, for example by using a well known thermal transfer system, in which a heated electrode, in pin form, transfers oleophilic material to the cylinder jacket 3 (see, for example, U.S. Pat. No. 4,846,065, Mayrhofer et al). Other systems use ink jets or similar processes. Such imaging apparatus or systems can be located directly within the printing machine or on the printing machine.

In accordance with the present invention, dampening of the non-imaged areas, in accordance with lithographic printing, is obtained directly from the interior of the porous ceramic jacket 3 on the cylinder 1. This has a particular advantage in that separate dampeners, together with dampener rollers and the like and/or ink-dampening fluid combination application rollers are not necessary. The elimination of the dampener, together with its drive and all the rollers in connection therewith, some of which may be vibrating, is a substantail saving both as far as cost is concerned as well as space in a printing machine.

On those areas on which the surface 4 of the ceramic sleeve 3 has oleophilic material 7 applied thereto, pores 5 are no longer open but, rather, are plugged. Dampening fluids, thus, cannot reach the surface 4 where the imaged, to be inked material is applied. Dampening fluid can only travel to the surface, as schematically seen by arrow 8 (FIG. 3). Thus, in desired and controlled arrangements, the surface 4 of the cylinder sleeve or jacket 3 will have oleophilic area portions or regions and hydrophilic area portions or regions.

The cylinder can be re-used with different printing information. For re-use, it is necessary to remove the previously applied oleophilic regions 7. This can be done, for example, by low-pressure plasma treatment, burning off with an oxygen hydrogen gas flame, or by mechanical removal, for example by grinding or peeling off. In accordance with a feature of the invention, the porosity of the form cylinder 1 can be used by applying, instead of dampening fluid from the chamber 6, hot steam or other hot gases which percolate through the pores to the surface 4, and lift off the oleophilic image areas 7, or, respectively, crack or spall them off. This erasing method has the advantage that the attack to remove the oleophilic regions 7 occurs directly at the critical points, that is, at those points on which the image carrying material 7 has been applied, and it is not necessary to first soften various atomic or molecular layers of the material 7 before the adhesion between the oleophilic material 7 and the surface 4 is sufficiently weakened so that the material 7 can be removed, or drops off, spalls off or drips off.

We claim:

1. Self-dampening erasable rotary lithographic printing form having a cylindrical core (2);

a hollow cylindrical sleeve or jacket (3) fitted over the core (2), said cylindrical sleeve or jacket having an outer surface (4) which is hydrophilic, in combination with oleophilic or hydrophobic material (7) applied to said outer surface (4) of the sleeve or jacket (3) in accordance with image or printed subject matter information to permit inking of the oleophilic or hydrophobic material in accordance with the image or printed subject matter information, wherein, in accordance with the invention, the cylindrical sleeve or jacket is of essentially noncompressible material selected from the group consisting of ceramic, glass, and a metallic material, optionally sintered powder metals of bronze or chromium-nickel alloys, which sleeve or jacket is formed with a plurality of pores (5) essentially uniformly distributed over the surface (4) thereof, said pores forming a connected pore fluid transfer network between an inner surface at the interior of the sleeve and the outer surface (4) thereof; and dampening fluid supply means (2*a*, 2*b*, 6) are provided for supplying dampening fluid into the interior of the sleeve or jacket including a fluid supply chamber bounded at one side thereof by the interior of said sleeve or jacket (3), and exposed to said connected pore fluid transfer network, and fluid conduct means (2*a*, 2*b*) leading to said chamber (6), whereby dampening fluid will travel through the pore transfer network to the outer surface (4) of the sleeve or jacket through pores which are open at said outer surface and provide dampening fluid to said outer surface except at locations where said oleophilic or hydrophobic material is deposited on the outer surface and blocks the pores (5) at said outer surface.

2. The form of claim 1, wherein said connected pore fluid transfer network extends, from the inner surface of the sleeve to the outer surface (4) thereof.

3. The form of claim 1, wherein the porosity of said cylindrical sleeve or jacket (3) is between about 20% and 45%.

4. The form of claim 1, wherein the diameter of the pores within the sleeve or jacket (3) is non-uniform and decreases in size from the inner surface of the sleeve or jacket towards the outer surface (4) thereof.

5. The form of claim 4, wherein said cylindrical core (2) is ferrous, optionally steel, for effective stabilization of the porous cylindrical sleeve or jacket.

6. The form of claim 1, wherein the diameter of the pores changes in dependence of the distance of the pores from the outer surface (4) towards the inner surface thereof.

7. The form of claim 1, wherein the average diameter of the size of the pores is between about 0.003 to 0.1 mm.

8. The form of claim 1, wherein the average or median diameter of the pores varies in dependence of the distance of the individual pores from the outer surface (4), and the size of the pores is in the range of between 0.003 to 0.1 mm, with the smallest pores at the outer surface (4) of the sleeve or jacket (3).

9. The form of claim 1, wherein said cylindrical core (2) is ferrous, optionally steel, for effective stabilization of the porous cylindrical sleeve or jacket.

10. The form of claim 1, wherein the diameter of the pores within the sleeve or jacket (3) is non-uniform and decreases in size from the inner surface of the sleeve or jacket towards the outer surface (4) thereof; and wherein the porosity of said cylindrical sleeve or jacket (3) is between about 20% and 45%.

11. A method of lithographic printing comprising providing a printing form, having a cylindrical core (2);

a hollow cylindrical sleeve or jacket (3) fitted over the core (2), said cylindrical sleeve or jacket having an outer surface (4) which is hydrophilic and which, further, is adapted to accept deposits of oleophilic, or hydrophobic material (7) thereon, to permit inking of the hydrophobic material in accordance with a printing image, wherein the cylindrical sleeve or jacket is of essentially non-compressible material selected from the group consisting of ceramic, glass, and a metallic material, optionally sintered powder metals of bronze or chromium-nickel alloys, which sleeve or jacket is formed with a plurality of pores (5) essentially uniformly distributed over the surface (4) thereof, said pores forming a connected pore fluid transfer network between an inner surface at the interior of the sleeve and the outer surface (4) thereof; and dampening fluid supply means (2*a*, 2*b*, 6) are provided for supplying dampening fluid into the interior of the sleeve or jacket including a fluid supply chamber bounded at one side thereof by the interior of said sleeve or jacket (3), and exposed to said connected pore fluid transfer network, and fluid conduct means (2*a*, 2*b*) leading to said chamber (6), said method comprising applying oleophilic printed image material (7) to selected surface portion of the outer surface (4) of the sleeve or jacket to thereby plug the pores (5);

conducting dampening fluid from the interior of the porous sleeve or jacket (3) to open pores (5) between said selected surface portions; and inking said printing form.

12. The method of claim 11, wherein said step of conducting dampening fluid from the interior of the sleeve or jacket comprises applying said dampening fluid to the inner surface of said sleeve or jacket (3), and causing said fluid to flow through said connected pore fluid transfer network to the outer surface (4) of the sleeve or jacket.

13. The method of lithographic printing of claim 11, wherein the diameter of the pores within the sleeve or jacket (3) is non-uniform and decreases in size from the inner surface of the sleeve or jacket towards the outer surface (4) thereof, whereby the pores at the inner surface of the sleeve will be larger than at the outer surface, wherein said method step of applying oleophilic printed image material (7) comprises applying said oleophilic material to the smaller pores at said selected surface portions (4) of the sleeve or jacket; and the step of conducting dampening fluid comprises conducting said dapening fluid from the larger pores of the inner surface of the porous sleeve or jacket (3) through the increasingly smaller pores to open pores (5) between said selected surface portions.

14. The method of lithographic printing of claim 11, wherein said cylindrical core (2) is ferrous, optionally steel, for effective stabilization of the porous cylindrical sleeve or jacket (3).

15. A method of erasing an image on a lithographic printing form, wherein the lithographic printing form has a cylindrical core (2);

a hollow cylindrical sleeve or jacket (3) fitted over the core (2), said cylindrical sleeve or jacket having an outer surface (4) which is hydrophilic and on which, further, deposits of oleophilic or hydrophobic image material (7) are bonded in accordance with an image to be printed, wherein the cylindrical sleeve or jacket is of essentially non-compressible material selected from the group consisting of ceramic, glass, and a metallic material, optionally sintered powder metals of bronze or chromium-nickel alloys, which sleeve or jacket is formed with a plurality of pores (5) essentially uniformly distributed over the surface (4) thereof, said pores forming a connected pore fluid transfer network between an inner surface at the interior of the sleeve and the outer surface (4) thereof, and fluid supply means (2*a*, 2*b*, 6) are provided for supplying fluid into the interior of the sleeve or jacket including a fluid supply chamber bounded at one side thereof by the interior of said sleeve or jacket (3), and exposed to said connected pore fluid transfer network, and fluid conduct means (2*a*, 2*b*) leading to said chamber (6), said erasing method comprising conducting a hot gas, forming said fluid, to the inner surface of the sleeve or jacket (3), for transfer through said connected pore fluid network to the outer surface, to thereby weaken the bond between the oleophilic image material (7) and the sleeve or jacket (3) and permit its removal.

16. The method of claim 15, wherein said hot gas comprises steam.

* * * * *